United States Patent [19]

Kahan

[11] 4,188,902

[45] Feb. 19, 1980

[54] BOBBIN THREAD RUN-OUT DETECTORS

[75] Inventor: William Kahan, New York, N.Y.

[73] Assignee: The Singer Company, New York, N.Y.

[21] Appl. No.: 40,022

[22] Filed: May 18, 1979

[51] Int. Cl.[2] ..... B65H 63/02; D05B 69/00

[52] U.S. Cl. ..... 112/278; 250/571

[58] Field of Search ..... 112/278, 273; 139/273 A; 242/47.12, 37 R; 250/571

[56] References Cited

U.S. PATENT DOCUMENTS

| | | | |
|---|---|---|---|
| 2,350,397 | 6/1944 | Haas | 112/273 |
| 3,082,968 | 3/1963 | Reichelt et al. | 112/278 X |
| 3,599,586 | 8/1971 | Newman | 112/278 |
| 3,631,901 | 1/1972 | Langenbach et al. | 139/273 A |
| 3,670,976 | 6/1972 | Vischiani | 242/47.12 |
| 3,777,168 | 12/1973 | Sansone | 139/273 A X |
| 3,845,320 | 10/1974 | Winberg | 112/278 X |

FOREIGN PATENT DOCUMENTS

| | | | |
|---|---|---|---|
| 48-0555273 | 1/1973 | Japan | 112/278 |
| 49-6885674 | 7/1974 | Japan | 112/278 |
| 50-0118859 | 9/1975 | Japan | 112/278 |
| 50-0133044 | 10/1975 | Japan | 112/278 |
| 50-0133047 | 10/1975 | Japan | 112/278 |
| 54-46648 | 4/1979 | Japan | 112/278 |

*Primary Examiner*—Peter P. Nerbun

*Attorney, Agent, or Firm*—Robert E. Smith; Edward L. Bell; Michael H. Wallach

[57] ABSTRACT

A bobbin thread run-out detector having a light source and means for directing a beam of light toward a set of retro-reflecting reflectors on the bobbin and toward a reference reflecting spot on the loop taker. Bobbin thread wound around the bobbin is interposed between the light source and the retro-reflecting reflectors. When a sufficient quantity of thread has been consumed to expose the indentations to the source of light, the light is reflected to a photodetector. Light from the source is also intermittently reflected onto the photodetector by the reflecting spot on the loop taker during each revolution of the loop taker. An electronic circuit compares the light received by the photodetector from the bobbin with the light received from the reflecting spot on the loop taker. When the quantity of light reflected from the bobbin changes relative to the quantity of light reflected from the loop taker a low bobbin thread alarm is activated to warn the operator of the impending exhaustion of bobbin thread.

11 Claims, 3 Drawing Figures

BOBBIN THREAD RUN-OUT DETECTORS

BACKGROUND OF THE INVENTION

1. Field of the Invention

This invention relates to sewing machines in general and more particularly to a detector for advising a sewing machine operator of the impending depletion of bobbin thread.

2. Description of the Prior Art

Bobbin thread run-out detectors for warning a sewing machine operator of the impending exhaustion of bobbin thread are known in the prior art. Some forms of prior detectors utilize a light source which is aimed across a thread-carrying bobbin toward a photodetector located on the opposite side of the bobbin. When the bobbin contains a quantity of thread, the light is blocked from illuminating the photodetector. The photodetector is exposed to light only after the quantity of thread wound on the bobbin has been depleted during the sewing process. Still other prior bobbin thread run-out detectors have employed a bobbin having a core containing a plurality of reflecting surfaces and a light source and photodetector located on the same side of the bobbin. Light from the source is aimed at the reflective bobbin core, and is scattered as long as bobbin thread remains wrapped around the core. When the core is exposed by the depletion of bobbin thread, the light is reflected from the core toward the photodetector which operates a device to warn the operator of the impending exhaustion of bobbin thread. Bobbin thread run-out detectors are also known in which the bobbin is constructed with an annular thread storage flange located between the end flanges. The thread storage flange forms a storage cavity in which the last remaining wraps of bobbin thread are contained. A light source and photodetector are placed so that the bobbin is interposed therebetween, with the optical axis joining the light source and photodetector offset from the axis of rotation of the bobbin, but nevertheless contained within the radius of the storage flange. If the bobbin is properly wound with thread, the thread contained within the storage cavity will not be consumed until all other thread is removed from the bobbin during the sewing process. As thread is removed from the storage cavity the optical path between the light source and the photodetector will be exposed, thereby allowing light to impinge on the photodetector, which may activate a device to warn the sewing machine operator of the impending depletion of bobbin thread.

One problem with some known sewing machine bobbin thread run-out detectors is that they require a light source and photodetector placed at opposite sides of the loop taker, in areas which are crowded with other sewing machine instrumentalities.

Another problem is that the sensitivety and reliability of some bobbin thread run-out detectors vary with the age, voltage, and temperature of the constituent components.

Still another problem is that some prior known bobbin thread run-out detectors could not be adjusted to activate an alarm when a variable quantity of thread remained on the bobbin.

Another problem with some known bobbin thread run-out detectors is that the light source and photodetector are located in areas which are susceptible to impaired operation due to lint and fabric debris which collect in the loop taker cavity.

Still another problem is that bobbin thread run-out detectors which utilize bobbins having a thread storage flange for segregating the last wraps of bobbin thread must be properly filled with thread in a special manner to operate properly.

Another problem is that bobbin thread run-out detectors which have a light source on one side of the bobbin and the photodetector on the other side require that apertures be machined in the bobbin case for the passage of light therethrough.

Still another problem is that some known bobbin thread run-out detectors are susceptible to false readings due to the presence of stray light in the area surrounding the photodetector.

SUMMARY OF THE INVENTION

It is an object of this invention to provide a bobbin thread run-out detector which will signal a sewing machine operator of the impending exhaustion of bobbin thread.

It is also an object of this invention to provide a bobbin thread run-out detector which operates from a modular light source and photodetector which is easily incorporated into the bed of a sewing machine.

Another object of this invention is to provide a bobbin thread run-out detector which is minimally susceptible to stray light in the vicinity of the loop taker or to the aging or the effect of temperature variation on electronic components.

Still another object is to provide a bobbin thread run-out detector which may be adjusted to operate when differing quantities of thread remain on the bobbin.

The above and other objects of this invention are achieved by arranging a light source and optical transmission system beneath the loop taker so that light may be directed through apertures contained in the base of the loop taker and the base of the bobbin case toward the intersection of the top flange of the bobbin with the bobbin core. The top flange of the bobbin contains a set of retro-reflecting reflectors which reflect light along a coincident path. The optical transmission system also contains a beam splitter which permits light from the source to be directed toward a reference reflecting spot carried on the underside of the loop taker. A photodetector is positioned beneath the beam splitter so that light reflected from either the reference spot on the loop taker or from the bobbin will impinge thereon. The reference reflecting spot is positioned on the loop taker so that light reflected therefrom will be out of phase with light reflected from the bobbin through the aperture in the base of the loop taker. An electronic logic circuit compares the quantity of light received by the photodetector from the reflective spot on the loop taker with the quantity reflected from the bobbin. When the retro-reflecting reflectors on the top flange of the bobbin are exposed to light due to the depletion of bobbin thread the quantity of light reflected from the bobbin will increase relative to the quantity of light reflected from the reference spot on the loop taker. An optical encoder which is connected to the bed shaft provides timing signals to an electronic logic circuit which includes an analog-to-digital converter, which converts the analog electrical signals produced by the photodetector into numbers which are representative of the quantity of light reflected from the loop taker and the bobbin. The numbers are compared in an adder circuit. If the value of the bobbin signal increases relative to the value of the signal from the reference spot, a bobbin thread run-out alarm is activated to warn the sewing machine operator of the impending exhaustion of bobbin thread.

BRIEF DESCRIPTION OF THE DRAWINGS

The above and other objects of this invention will become evident from a full and complete understanding of the preferred embodiment which is hereinafter set forth in such detail as to enable those skilled in the art to readily understand the function, operation, construction, and advantages of it where read in conjunction with the accompanying drawings in which.

DESCRIPTION OF THE PREFERRED EMBODIMENT

Figure 1:
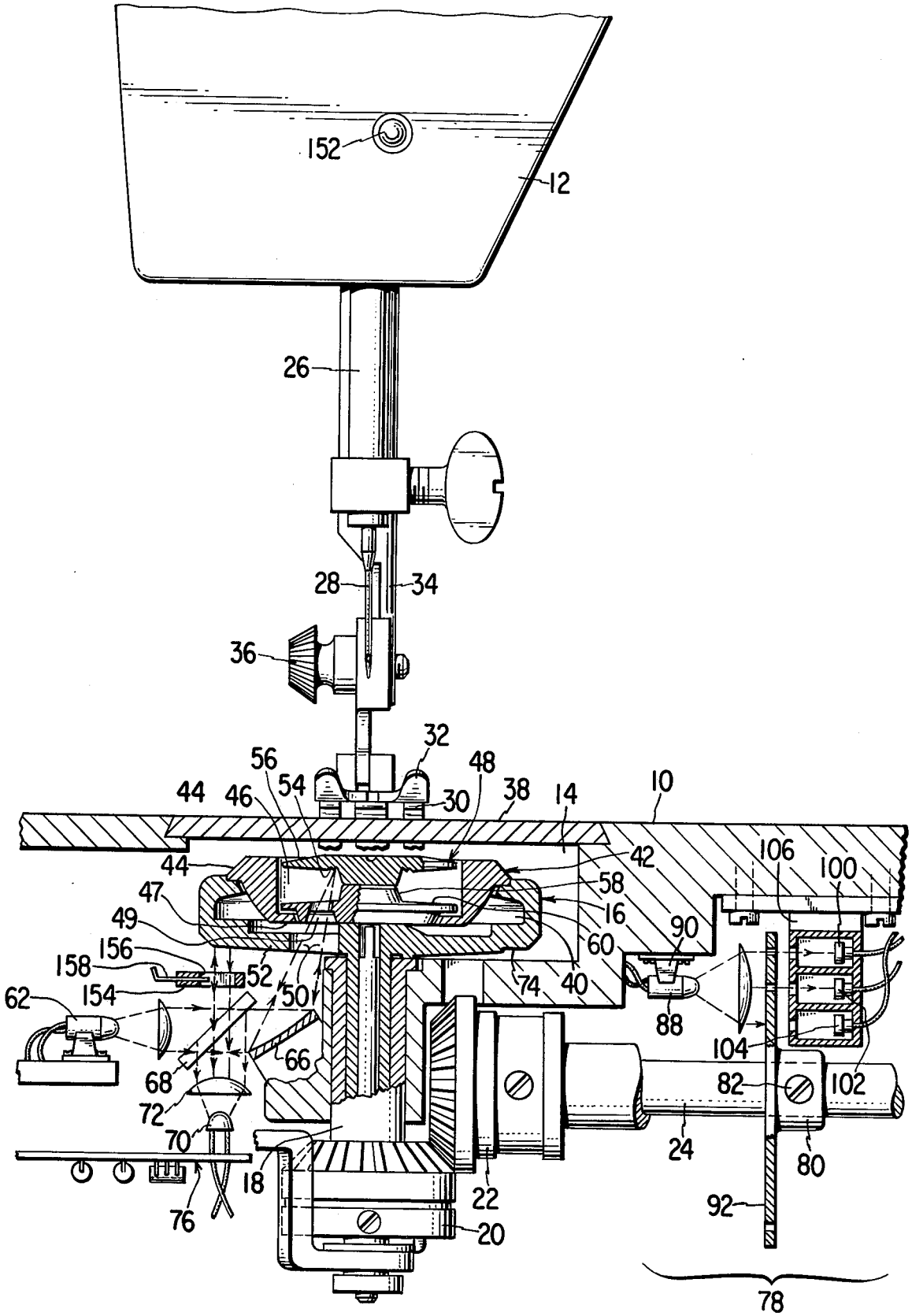
FIG. 1 is a front view partially in section of a portion of a sewing machine having a bobbin thread run-out detector constructed in accordance with the teachings of this invention.

Referring to the drawings, in FIG. 1 shows a portion of a sewing machine having a bed 10 and a sewing head 12 overhanging the bed 10. The bed 10 contains a cavity 14 in which a loop taker 16 is rotatably carried on one extremity of a shaft 18 shown in the preferred embodiment having a vertical axis. Fastened to the extremity of the shaft 18 opposite the loop taker 16 is a bevel gear 20 which is driven by a second bevel gear 22 fastened to a drive shaft, a fragment of which is shown at 24. The loop taker 16 rotates in timed synchronization to the reciprocation of a needle bar 26 which is reciprocatorily carried in the sewing head 12. Fastened to the needle bar 26 is a needle 28 which is driven in endwise reciprocatory motion through a fabric supported on the sewing machine bed 10. The fabric may be moved along a line of feed on the bed 10 by the compound motion of a feed dog, a fragment of which appears at 30, which acts against the thrust of a presser foot 32 which is fastened to a presser bar 34 by a clamp screw 36. The feed dog 30 is driven in timed relation to the motion of the needle bar 26 by a mechanism which is well known in the prior art and which need not be understood for a full and complete understanding of the present invention. Preferably a slide plate 38 encloses a portion of the cavity 14. A throat plate (not shown) encloses the remainder of the cavity 14 and supports the fabric against the thrust of the needle 28.

The loop taker 16 contains a cavity 40 in which is supported a bobbin case 42 whose periphery is defined by a wall 44. The bobbin case 42 is restrained from partaking of motion with the loop taker by means which are well known in the prior art. See for example, the U.S. patent application Ser. No. 4,117 of W. Herron et al, which was filed on Jan. 17, 1979, the teachings of which are incorporated herein by reference. The bobbin case 42 contains a cavity 46 in which resides a bobbin 48 which may be filled with a quantity of thread (not shown) for concatenation with thread carried by the needle 28 during the well known process of forming lockstitches. The bobbin 48 resides on a lower surface shown as an annular ledge 47 which projects from the lower extremity of the wall 44 and is freely rotatable within the bobbin case 42 in response to the withdrawal of thread therefrom during the sewing process. The annular ledge 47 has an aperture 49 formed therethrough.

It will be readily appreciated by one skilled in the art of sewing that it is inconvenient to exhaust the supply of bobbin thread while in the middle of a sewing project. Inasmuch as the bobbin is located within the sewing machine bed 10 over which is draped the garment or fabric being sewn, it will be appreciated that it is difficult to readily observe the quantity of thread remaining on the bobbin while carrying out the sewing process. To the end of alleviating the problems attendant with observing the quantity of bobbin thread, a mechanism which will signal the sewing machine operator to the approaching exhaustion of bobbin thread will find particular utility in minimizing the inconvenience of running out of bobbin thread during a sewing project.

The bobbin thread run-out detector disclosed herein is generally carried out by directing a beam of light through an aperture 50 formed in a lower surface 52 of the loop taker 16 toward a set of retro-reflecting reflectors 54 which may preferably be annular grooves formed in a top flange 56 of the bobbin 48. It will be obvious to one skilled in the art of sewing machine construction that the last quantity of thread to be consumed from a bobbin during the sewing process is that which is wrapped around a core 58 which separates a bottom flange 60 of the bobbin from the top flange 56. Light which is projected through the aperture 50 toward the retro-reflecting reflectors 54 will not reach the reflectors 54 when thread remains on the core 58. When, however, the length of thread remaining on the core 58 is insufficient to prevent light from reaching the reflectors 54, the light will be reflected back along a coincident path toward the source due to the shape of the reflectors 54.

Light for operating the bobbin thread run-out detector is supplied by a light source which is shown in the preferred embodiment as a solid state light emitter 62. Preferably a collimating lens 64 and a concave mirror 66 collimate the light from the source 62 and direct it through the aperture 50 toward the indentations 54, the lower flange 60 being preferably formed from a transparent material such as plastic to permit light to be transmitted therethrough. Preferably an optical beam splitter 68 is interposed between the lens 64 and the mirror 66 to direct light reflected from the retro-reflecting refelectors 54 and the mirror 66 toward a photodetector, as for example a phototransistor 70. Preferably a focusing lens 72 is positioned between the beam splitter 68 and the phototransistor 70 to concentrate the light impinging on the phototransistor 70.

FIG. 1 also shows that the lower surface 52 of the loop taker 16 contains a reference reflecting spot 74 which is polished to reflect light therefrom. The spot 74 is located on a portion of the loop taker surface 52 so that it is angularly displaced from the aperture 50. A portion of the light from the source 62 is directed toward the reference reflecting spot 74 by the beam splitter 68 and is reflected back from the spot 74 through the beam splitter 68 and toward the photodetector 70 when the spot 74 is aligned with the photodetector 70. Since the aperture 50 and the reference reflecting spot are angularly displaced one from the other, the photodetector 70 will receive light reflected from the bobbin reflectors 54 through the mirror 66 and beam splitter 68 at a time different from that at which light is received from the loop taker spot 74 through the beam splitter 68. It should be understood that while the spot 74 is shown on a surface of the loop taker 16, it may be contained on any surface which partakes of periodic motion in timed synchronization to the rotation of the loop taker 16.

Figure 2:
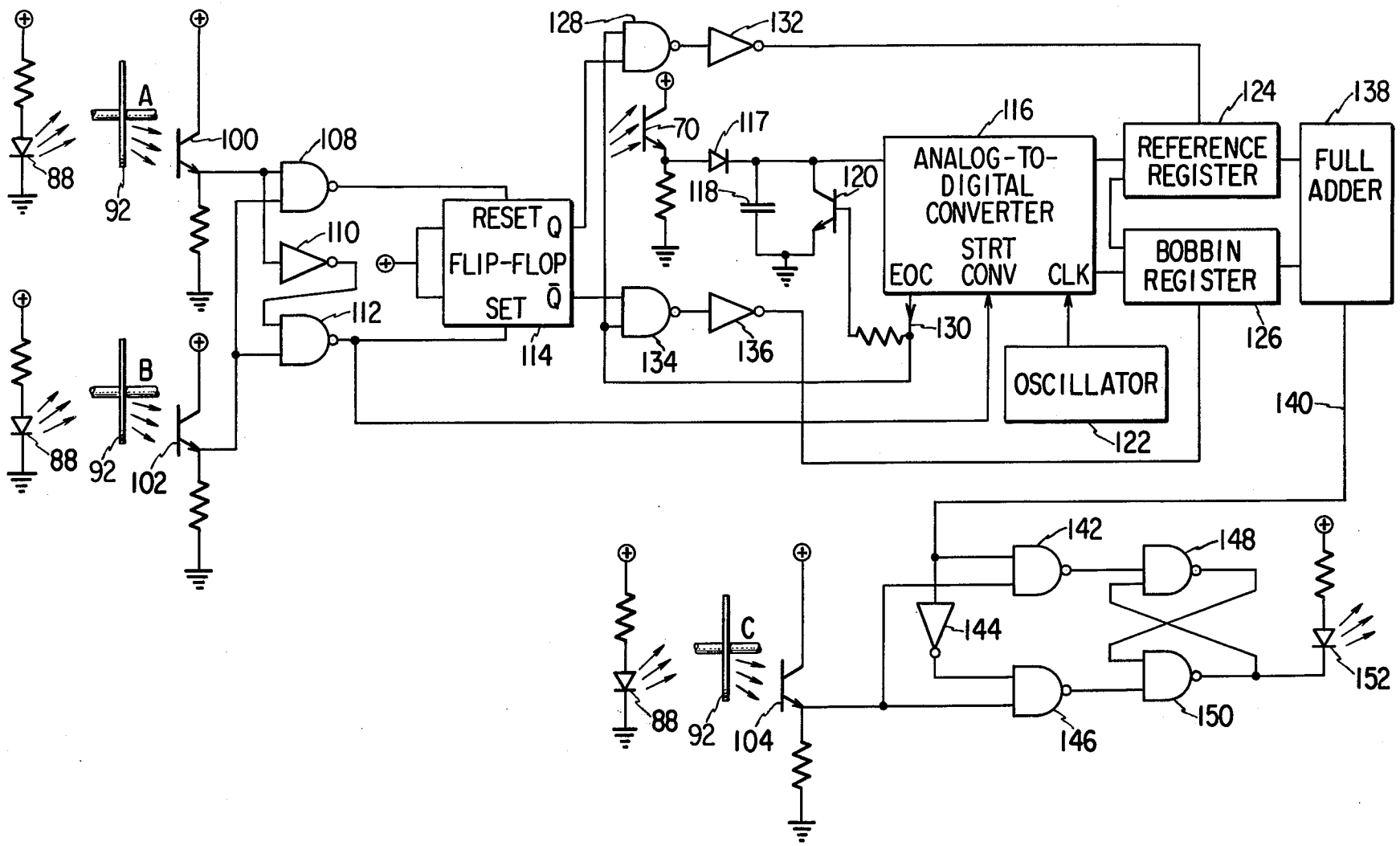
FIG. 2 is an electronic logic diagram of the bobbin thread run-out detector.
Figure 3:
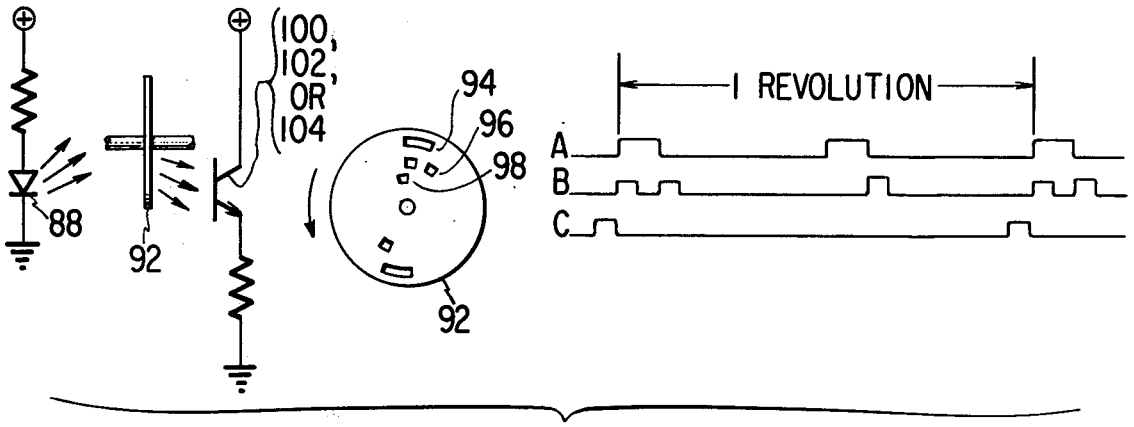
FIG. 3 is a view of an optical encoder disc and a representation of the timing signals which are produced by the encoder and which are used to synchronize the operation of the electronic logic circuit to the rotation of the loop taker.

An electronic circuit means, which is shown generally in FIG. 1 at 76 and in schematic format in FIG. 2 may be used to activate a bobbin thread run-out alarm in response to signals supplied by the bobbin thread run-out detector to advise the sewing machine operator of the impending exhaustion of bobbin thread. The circuit 76 is operated in timed relation to the rotation of the loop taker 16 by signals generated by the rotation of an optical encoder which is shown generally at 78 in FIG. 1. Preferably the optical encoder is fastened to the drive shaft 24 with a collar 80 and a set screw 82. The gear 20 and the gear 22 each have an identical number of teeth, thereby insuring an identical rate of rotation between the encoder 76 and the loop taker 16. While the encoder 78 is shown preferably fastened to the shaft 24, it will be obvious that it may be driven by any sewing machine instrumentality which rotates at an identical rate with the loop taker 16. A light source, as for example the light emitting diode 88, is supported by a bracket 90 on one side of the optical encoder 78. Preferably the optical encoder 78 has a disc surface 92 with a plurality of apertures cut therein; the apertures being spaced at three radial distances 94, 96, and 98 from the center of the disc surface 92, as is best shown in FIG. 3. Three photodetectors, preferably shown as a set of phototransistors 100, 102, and 104 are carried in a support enclosure 106 on an opposite side of the optical encoder disc surface 92, the disc 92 being interposed between the light source 88 and the phototransistor enclosure 106. The phototransistors 100, 102, and 104 are spaced within the enclosures 106 so that light passing through one or more apertures formed on the disc 92 at the radial distance 94 will impinge on the phototransistor 100; light passing through apertures formed on the disc 92 at the radial distance 96 will impinge on the phototransistor 102; and light passing through apertures formed on the disc 92 at the radial distance 98 will impinge on the phototransistor 104.

FIG. 3 shows a chart of the electrical signals which are generated by the phototransistors 100, 102, and 104 during one revolution of the disc 92 as a result of light from the source 88 passing through the apertures contained on the disc surface 92 and striking the phototransistors 100, 102, and 104.

Signal A of FIG. 3, which is representative of the electrical output of the phototransistor 100 during one revolution of the disc 92, shows that two square waves are generated by the phototransistor 100 during one revolution of the disc 92; signal B shows that three square waves are generated by the phototransistor 102 during one revolution of the disc 92; and signal C shows that one square wave is generated by the phototransistor 104 during one revolution of the disc 92. It may be seen from FIG. 3 that the duration of the square waves generated by light passing through an aperture on the disc 92 is related to the arcuate length of the respective aperture; as for example the square waves generated by the phototransistor 100 are longer in duration than the square waves generated by the phototransistor 102 as a result of the arcuate length of the apertures contained at the radial distance 94 being greater than the arcuate length of the apertures contained at the radial distance 96. Similarly, the square waves generated by the phototransistor 104 are of equal duration to the square waves generated by the phototransistor 102 since the arcuate length of the apertures at the radial distance 98 are equal to the arcuate length of the apertures contained at the radial distance 96.

Referring to the electronic logic diagram shown in FIG. 2, it may be seen that the output of the phototransistor 100 is applied to a NAND gate 108 and through an inverter 110 to a NAND gate 112. The output of the phototransistor 102 is also applied to the NAND gate 108 and the NAND gate 112. The output of the NAND gate 112 is applied to the set gate of a FLIP-FLOP 114, and the output of the NAND gate 108 is applied to the reset gate of the FLIP-FLOP 114. The output of the NAND gate 112 is also applied to an analog-to-digital converter 116 to control the time at which the converter 116 commences the conversion of analog signals applied thereto. The analog to digital converter is of a conventional design, as for example a National Semiconductor brand Model ADC0800 8-bit A/D converter.

Connected to the input terminal of the analog-to-digital converter 116 through a diode 117 is the photodetector 70 which receives light reflected from either the reference reflecting spot 74 on the loop taker 16 or from the retro-reflecting reflectors 54 on the bobbin 48. Also connected to the analog-to-digital converter 116 is a storage capacitor 118 and a switching transistor 120. The capacitor 118 is charged to the peak voltage generated by the photodetector 70, which is proportional to the peak value of light reflected onto the photodetector 70 by either the reflectors 54 or the reference spot 74. A clock signal, which is generated by an electronic oscillator 122 of any conventional design which may be familiar to those skilled in the art of analog-to-digital converters, is applied to the analog-to-digital converter 116 to control the rate at which the voltage applied thereto by the capacitor 118 is converted into a digital number.

The digital number which is produced by the analog-to-digital converter 116 is loaded into either a reference register 124 or a bobbin register 126, depending on the state of the FLIP-FLOP 114. When the optical encoder disc 92 is positioned so that light simultaneously impinges on the phototransistor 100 and the phototransistor 102, the output of the NAND gate 108 will be low, and the output of the NAND gate 112 will be high. The output from the NAND gate 112 will toggle the FLIP-FLOP 114 into a set state which will cause a high signal to be supplied to a NAND gate 128. The NAND gate 128 is also supplied with an input from the analog-to-digital converter 116 via a line 130, whose state is high when the converter 116 has completed the conversion of the analog signal stored in the capacitor 118 into a binary number. The output of the NAND gate 128 is supplied through an inverter 132 to the reference register 124. When the FLIP-FLOP 114 is in a set state and the line 130 from the converter 116 is high, the output of the NAND gate 128 is low and the output from the inverter 132 is high. The output of the inverter 132 causes the register 124 to store data supplied thereto by the analog-to-digital converter 116 when both inputs to the NAND circuit 128 are high, which corresponds to the time when the phototransistor 100 and the transistor 102 are simultaneously receiving light through the disc 92 from the source 88.

When the optical disc 92 has rotated so that only the phototransistor 102 is receiving light from the source 88, the output of the NAND gate 108 is high and the output of the NAND gate 112 is low. The output of the NAND gate 108 will reset the state of the FLIP-FLOP 114, which will supply a high state to one input of a NAND gate 134 having an inverter 136 connected to its output. A second input to the NAND gate 134 is supplied from the analog-to-digital converter 116 via the line 130. When the output of the NAND gate 134 is low, the output of the inverter 136 will be high. The output of the inverter 136 is connected to the bobbin register 126 and causes data from the analog-to-digital converter 116 to be routed thereto when both inputs to the NAND gate 134 are in a high state.

When the analog-to-digital converter 116 has completed converting the voltage stored on the capacitor 118 into a digital number, the line 130 is raised to a high state by the converter 116, which causes a transistor 120 to conduct, which discharges the capacitor 118 to ground. The capacitor 120 will be charged by the phototransistor 70, when light is next reflected thereto by either the bobbin reflectors 54 or the hook reflecting spot 74.

The contents of the reference register 124 and the bobbin register 126 are supplied to a full adder 138 wherein the digital numeric representation of the signal generated by the photodetector 70 from the reflection of light from the retro-reflecting reflectors 54 is subtracted from the digital numeric representation of the signal supplied from the reflection of light from the reference reflecting spot 74. If the quantity of light reflected from the refelectors 54 increases relative to the quantity of light reflected from the reference spot 74, as will be the case when sufficient thread has been consumed from the bobbin core 58 during the sewing process, the subtraction process in the adder 138 will result in a positive carry value which will raise an output line 140 of the adder 138 to a high state. If the light reflected from the reflectors 54 is less than the light reflected from the reference spot 74, as will be the case when there is sufficient thread wrapped about the core 58 to occlude the reflectors 54, the subtraction process in the adder 138 will result in a negative carry value, which will result in the state of the line 140 remaining low.

The line 140 is connected to a NAND gate 142 and through an inverter 144 to a NAND gate 146. A second input to the NAND gate 142 and to the NAND gate 146 is supplied from the phototransistor 104 which is responsive to light transmitted through an aperture in the disc 92 at the radial distance 98 thereon. The output of the NAND gate 142 is supplied to a NAND gate 148 and the output of the NAND gate 146 is supplied to a NAND gate 150. A second input to the NAND gate 148 is supplied from the output of the NAND gate 150 and a second input to the NAND gate 150 is supplied from the output of the NAND gate 148. The output of the NAND gate 150 has a bobbin thread run-out alarm connected thereto, which is preferably shown as a light emitting diode 152.

When the bobbin 48 has been depleted of a sufficient quantity of thread to expose the reflectors 54 to light passing through the aperture 49 and the aperture 50, the quantity of light reflected therefrom onto the phototransistor 70 will increase relative to the quantity of light reflected onto the phototransistor 70 from the reference reflecting spot 74 carried on the loop taker 16. The digital number supplied to the bobbin register 126 by the analog-to-digital converter 116 will therefore increase relative to the value of the digital number loaded into the reference register. When the full adder 138 subtracts the digital number in the bobbin register 126 from the digital number in the reference register 124, the value of the result will be negative. The line 140 will therefore be in a high state. As the disc 92 completes its revolution the light from the LED 88 will impinge on the phototransistor 104, causing a high signal to be applied to the NAND gate 142 and the NAND gate 146. The NAND gates 148 and 150 are wired to form a latch which will activate the LED 152, and will keep it turned on until the sewing machine is turned off or the bobbin 48 is replenished with thread.

FIG. 1 also shows an adjustable shutter 154 which is interposed between the beam splitter 68 and the loop taker 16 to adjust the quantity of light transmitted between the source 62 and the reference spot 74. The shutter contains an aperture 156 and an adjustable diaphragm 158 which may be varied by the sewing machine operator. Since the quantity of light reflected by the retro-reflector 54 is inversely proportional to the quantity of thread remaining on the bobbin 48, the operator may vary the point at which the alarm 152 is activated by adjusting the quantity of light permitted to pass between the source 62 and the reference spot 74 by operation of the diaphragm 158.

It will be understood that stray light which falls on the photodetector 70 or dust or other debris which reduces the quantity of light falling on the photodetector will not affect the accuracy of the run-out detector since any change in the output of the photodetector will equally affect the numeric content of both the bobbin register 126 and the reference register 124. The full adder 138 will only activate the alarm 152 when the number in the bobbin register 126 changes relative to the number contained in the reference register 124.

From the above detailed description of a preferred embodiment of the invention it will be seen that a novel bobbin thread run-out detector has been disclosed which provides a positive indication of the impending exhaustion of bobbin thread. While the invention has been described in its preferred embodiment, it will be obvious to those skilled in the art that various changes and modifications may be made therein without departing from the spirit and scope of the invention as set forth in the appended claims. For example the function of the electronic logic circuit could be implemented in a microcomputer circuit, or the activation of the bobbin thread run-out alarm could initiate operation of a bobbin thread replenishing mechanism. All such modifications are intended to be included within the scope of the appended claims.

I claim:

1. In a sewing machine having a bed, a thread carrying needle reciprocatorily driven toward and away from said bed, a cavity formed in said bed, a loop taker having an axis rotatably journalled in said cavity, said loop taker having a first surface formed with an aperture, a bobbin case contained within said loop taker, said bobbin case having a first surface formed with an aperture, said first surface of said bobbin case abutting said first surface of said loop taker, a bobbin supported within said bobbin case, said bobbin having a circular flange distant from said first surface of said bobbin case, a near circular flange adjoining said first surface of said bobbin case and adapted to transmit light therethrough, and a central axial core, means carried on said distant flange for reflecting light transmitted through said near flange, said bobbin adapted to contain a supply of bobbin thread wrapped on said core and occluding said light reflecting means, a bobbin thread run-out detector comprising a source of light, means for directing light from said source through said apertures on the first surfaces of said loop taker and said bobbin case and through said near flange of said bobbin toward said reflecting means on said distant flange of said bobbin, a reference reflecting spot partaking of periodic motion in timed synchronization to the rotation of said loop taker, said spot being out of phase with said aperture on said first surface of said loop taker, means for reflecting light from said source toward said reference reflecting spot, photodetector means responsive to light reflected from said reference reflecting spot and from said reflecting means on said distant flange of said bobbin, electronic circuit means connected to said photodetector means for comparing the output of said photodetector means and signalling when the quantity of light reflected from said reflecting means carried on said bobbin changes relative to the quantity of light reflected from said reference reflecting spot.

2. The bobbin thread run-out detector as set forth in claim 1 further including timing means for sensing when said reference reflecting spot is in a position to reflect light toward said photodetector means, said timing means being operatively responsive to the rotation of said loop taker and signalling said electronic circuit means when said photodetector means is receiving light from said reference reflecting spot.

3. The bobbin thread run-out detector as set forth in claim 2 wherein said timing means comprises an optical shaft encoder, said encoder having an opaque disc rigidly fastened to a shaft rotatably driving said optical shaft encoder for in timed synchronization to the rotation of said loop taker, a source of light on a first side of said disc and at least one photodetector on a second side of said disc, and at least one aperture formed in said disc for intermittently optically communicating light from said source to said photodetector in response to the rate of rotation of said disc.

4. The bobbin thread run-out detector as set forth in claim 1 wherein said means carried on said distant flange of said bobbin for reflecting light comprises at least one retro reflecting geometry, said retro-reflector positioned along a circumference of said top flange to reflect light from said light source along a coincident path back toward said light source.

5. The bobbin thread run-out detector as set forth in claim 1 wherein said electronic circuit means includes an analog-to-digital converter for analyzing signals from said photodetector means, said analog-to-digital converter producing a digital number representative of the quantity of light received by said photodetector means.

6. The bobbin thread run-out detector as set forth in claim 5 further comprising a first electronic register means for storing the digital number produced by said analog-to-digital converter representative of the quantity of light received by said photodetector means from said reference reflecting spot, a second electronic register means for storing the digital number produced by said analog-to-digital converter representative of the quantity of light received by said photodetector means from said reflecting means carried on said bobbin top flange, and electronic circuit comparator means for determining when the digital number in said second electronic register means changes relative to the digital number in said first electronic register means.

7. The bobbin thread run-out detector as set forth in claim 6 wherein said electronic circuit comparator means operates an electronic latch, said latch enabling a low bobbin thread run-out alarm.

8. The bobbin thread run-out detector as set forth in claim 5 further comprising an electronic capacitor connected to said photodetector means, said capacitor being charged to a voltage representative of the output of said photodetector means and supplying said voltage to said analog-to-digital converter.

9. The bobbin thread run-out detector as set forth in claim 8 wherein said analog-to-digital converter produces an electronic signal to discharge said electronic capacitor after said converter has produced a digital number representative of the voltage retained on said capacitor.

10. The bobbin thread run-out detector as set forth in claim 2 wherein said reference reflecting spot is carried on said loop taker.

11. The bobbin thread run-out detector as set forth in claim 1 further comprising an operator adjustable means for varying the quantity of light transmitted from said light source to said reference reflecting spot.

* * * * *